United States Patent [19]

Ishikawa

[11] Patent Number: 4,656,428

[45] Date of Patent: Apr. 7, 1987

[54] DISTORTED WAVEFORM SIGNAL GENERATOR

[75] Inventor: Tomohisa Ishikawa, Kawagoe, Japan

[73] Assignee: Casio Computer Co., Ltd., Tokyo, Japan

[21] Appl. No.: 736,444

[22] Filed: May 21, 1985

[30] Foreign Application Priority Data

May 30, 1984 [JP] Japan ..... 59-108685

[51] Int. Cl.[4] ..... G10H 7/00; G10H 1/02

[52] U.S. Cl. ..... 328/14; 84/1.12; 84/1.13; 84/1.21; 84/1.24; 307/227

[58] Field of Search ..... 84/1.11, 1.12, 1.19, 84/1.21, 1.13, 1.24; 328/14; 307/227

[56] References Cited

U.S. PATENT DOCUMENTS 4,344,343 8/1982 Deforeit ..... 84/1.19
4,442,745 4/1984 Gross et al. ..... 84/1.19
4,535,669 8/1985 Kaneko ..... 84/1.11
4,539,884 9/1985 Aoki ..... 84/1.19

FOREIGN PATENT DOCUMENTS 2134933 1/1972 Fed. Rep. of Germany .
2906524 8/1979 Fed. Rep. of Germany .
2921363 1/1980 Fed. Rep. of Germany .
2135843A 9/1984 United Kingdom .

*Primary Examiner*—John S. Heyman
*Attorney, Agent, or Firm*—Frishauf, Holtz, Goodman & Woodward

[57] ABSTRACT

A step signal of which the period varies according to random data is derived from a step pulse generator, and is supplied to an address counter. By the output data from the address counter, an address of a waveform ROM is specified. From a waveform ROM, the waveform based on the random data is output in the form of a distorted waveform signal. Using this output signal of the distorted waveform, a cymbal sound, for example, is generated in a musical tone generator.

8 Claims, 12 Drawing Figures

| EX | SHIFT REGISTER SR1 | SR2 | SR3 | SR4 | RANDOM DATA N1 | NO | (DECIMAL) |
|---|---|---|---|---|---|---|---|
| 1 | 1 | 0 | 0 | 0 | 0 | 1 | (1) |
| 1 | 1 | 1 | 0 | 0 | 0 | 1 | (1) |
| 1 | 1 | 1 | 1 | 0 | 0 | 1 | (1) |
| 0 | 1 | 1 | 1 | 1 | 1 | 1 | (3) |
| 1 | 0 | 1 | 1 | 1 | 1 | 0 | (2) |
| 0 | 1 | 0 | 1 | 1 | 1 | 1 | (3) |
| 1 | 0 | 1 | 0 | 1 | 1 | 0 | (2) |
| 1 | 1 | 0 | 1 | 0 | 0 | 1 | (1) |
| 0 | 1 | 1 | 0 | 1 | 1 | 1 | (3) |
| 0 | 0 | 1 | 1 | 0 | 0 | 0 | (0) |
| 1 | 0 | 0 | 1 | 1 | 1 | 0 | (2) |
| 0 | 1 | 0 | 0 | 1 | 1 | 1 | (3) |
| 0 | 0 | 1 | 0 | 0 | 0 | 0 | (0) |
| 0 | 0 | 0 | 1 | 0 | 0 | 0 | (0) |
| 1 | 0 | 0 | 0 | 1 | 1 | 0 | (2) |
| 1 | 1 | 0 | 0 | 0 | 0 | 1 | (1) |

(REPEATED)

| ADDRESS DATA A3 | A2 | A1 | A0 | WAVEFORM DATA D3 | D2 | D1 | D0 |
|---|---|---|---|---|---|---|---|
| 0 | 0 | 0 | 0 | 0 | 0 | 0 | 0 |
| 0 | 0 | 0 | 1 | 0 | 0 | 1 | 0 |
| 0 | 0 | 1 | 0 | 0 | 0 | 1 | 1 |
| 0 | 0 | 1 | 1 | 0 | 1 | 0 | 1 |
| 0 | 1 | 0 | 0 | 0 | 1 | 1 | 0 |
| 0 | 1 | 0 | 1 | 1 | 0 | 0 | 0 |
| 0 | 1 | 1 | 0 | 1 | 0 | 0 | 1 |
| 0 | 1 | 1 | 1 | 1 | 0 | 1 | 0 |
| 1 | 0 | 0 | 0 | 1 | 0 | 1 | 1 |
| 1 | 0 | 0 | 1 | 1 | 1 | 0 | 0 |
| 1 | 0 | 1 | 0 | 1 | 1 | 0 | 1 |
| 1 | 0 | 1 | 1 | 1 | 1 | 1 | 0 |
| 1 | 1 | 0 | 0 | 1 | 1 | 1 | 0 |
| 1 | 1 | 0 | 1 | 1 | 1 | 1 | 1 |
| 1 | 1 | 1 | 0 | 1 | 1 | 1 | 1 |
| 1 | 1 | 1 | 1 | 1 | 1 | 1 | 1 |

DISTORTED WAVEFORM SIGNAL GENERATOR

BACKGROUND OF THE INVENTION

The present invention relates to a distorted waveform signal generator for generating signals with distorted waveforms, such as musical tone signals.

A conventional rhythm sound source for generating a rhythm sound with a timbre of the cymbals, for example, has generally been composed of a generator for generating distorted waveform signals having a timbre like the cymbals. In the generator, a trigger pulse is applied to a resonance circuit to generate a damping sinusoidal wave signal. A trigger pulse and white noise are applied to an envelope generator to obtain a white noise having a prescribed envelope waveform. The envelope waveform signal is applied to a low-pass filter to remove high frequency components from the envelope waveform signal. The output signal from the low-pass filter and the damping sinusoidal waveform signal are mixed. In this way, the distorted waveform signal is formed in an analog circuit.

In the case of the analog circuit, various characteristics of the circuit are greatly influenced by factors such as parts error and ambient temperature drift. The property of the sound, particularly timbre, is very sensitive to such factors. To cope with the problem, a circuit for removing such influence is additionally required. The use of the additional circuit makes it difficult to fabricate the generator by the LSI technology. Additional disadvantages of the conventional generator are the increased number of parts, an increased chip area as occupied, and complicated circuitry, and high cost to manufacture.

SUMMARY OF THE INVENTION

Accordingly, an object of the present invention is to provide a distorted waveform signal generator which is suitable for the LSI fabrication, and size reduction due to the decreased number of necessary parts, and manufactured in low cost, and further generates various kinds of sounds by one circuit.

According to this invention, a step signal the period of which randomly varies according to random data is generated. For reading out distorted waveform data, a read out period of a memory storing waveform data is randomly varied according to the step signal.

In summary, a distorted waveform signal generator according to the present invention comprises means for successively generating data containing random values, means for generating a step signal the period of which randomly varies according to the random data applied thereto, an address counter being stepwise driven by the step signal applied thereto, a waveform data memory which is addressed by the output signal from the address counter to sequentially output amplitude data corresponding to the waveform data, and means for generating a waveform signal the amplitude of which randomly changes according to the amplitude data successively applied thereto.

DETAILED DESCRIPTION OF THE PREFERRED EMBODIMENTS

Figure 1:
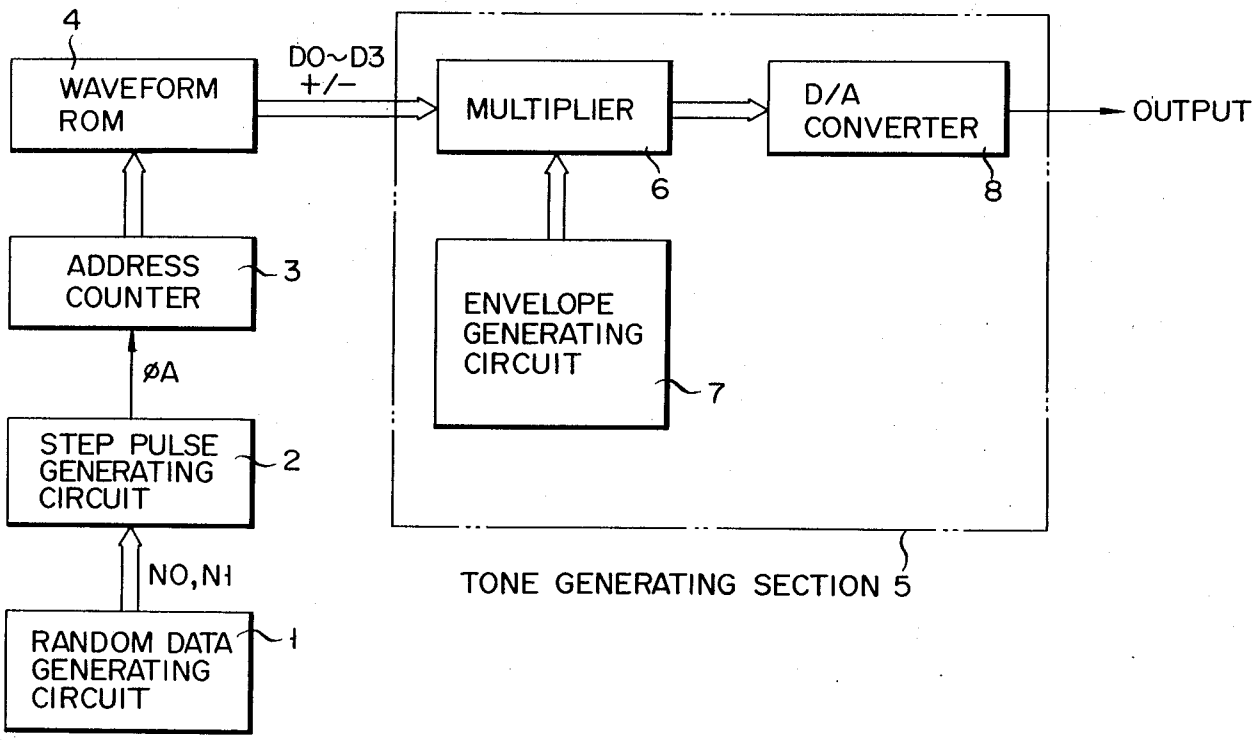
FIG. 1 is a block diagram showing an embodiment of a distorted waveform signal generator according to the present invention.

An embodiment of a distorted waveform signal generating circuit according to this invention will be described referring to the accompanying drawings. In FIG. 1, a random data generating circuit 1 generates binary data "N0, N1" of two bits. The output data is digital random data of which the values vary randomly. The random data "N0, N1" is supplied to a frequency control input terminal of a step pulse generating circuit 2. The pulse generating circuit 2 is a pulse generator of the type in which the frequency varies according to a control signal applied thereto. The circuit 2 may be a frequency dividing circuit for producing a frequency divided signal in a manner that a frequency dividing ratio of a clock signal $\phi$ of a predetermined period randomly varies according to random data. The frequency divided signal is used as a step pulse signal $\phi_A$ of which period randomly varies. The step signal $\phi_A$ is applied to an address counter 3. The address counter 3 sequentially counts the step pulse signal $\phi_A$ and the contents thereof are used for accessing an address of a waveform ROM 4, at random timings. Accordingly, the read out period of the waveform data D0 to D3 representative of amplitudes at the respective steps of a musical tone waveform read out of the ROM 4, changes randomly.

Figure 2:
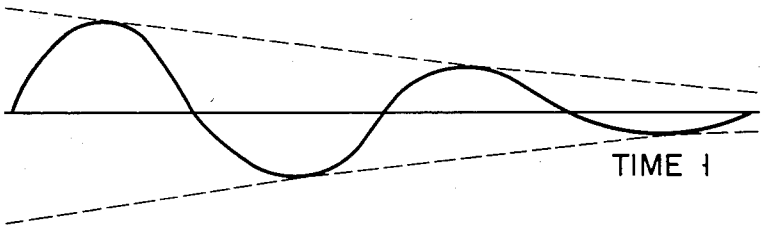
FIGS. 2 and 3 show a damping sinusodial waveform and a damping distorted waveform, respectively.
Figure 3:
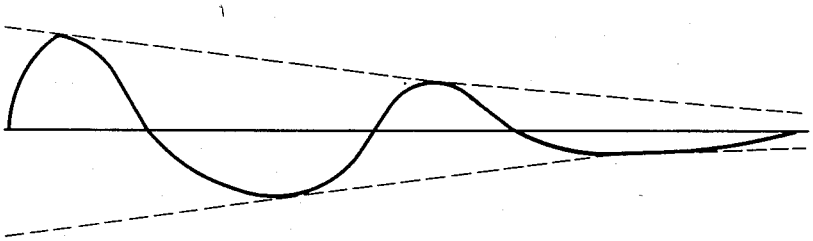

The waveform data D0 to D3 is applied to a multiplier 6 in a tone generating section 5. In the multiplier 6, the waveform data is multiplied by the envelope data generated by an envelope generating circuit 7. The product of these pieces of data is converted, by a D/A converter 8, into an analog signal. This analog signal is output in the form of a musical tone signal. In this way, a distorted damping waveform which is suitable for a cymbal sound, is obtained, as shown in FIG. 3. If the read out period is fixed, a sinusoidal waveform damping at a fixed rate is obtained, as shown in FIG. 2.

Figure 4:
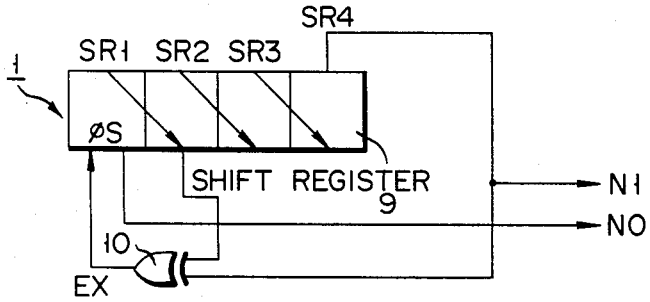
FIG. 4 is a circuit diagram of an example of a random data generating circuit used in the circuit of FIG. 1.
Figure 7:
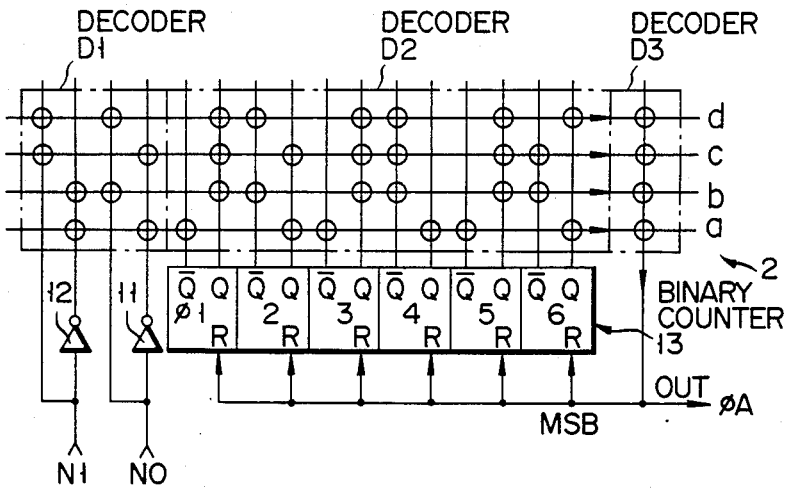
FIG. 7 is a circuit diagram showing an example of a step pulse generating circuit used in the circuit of FIG. 1.
Figure 8:
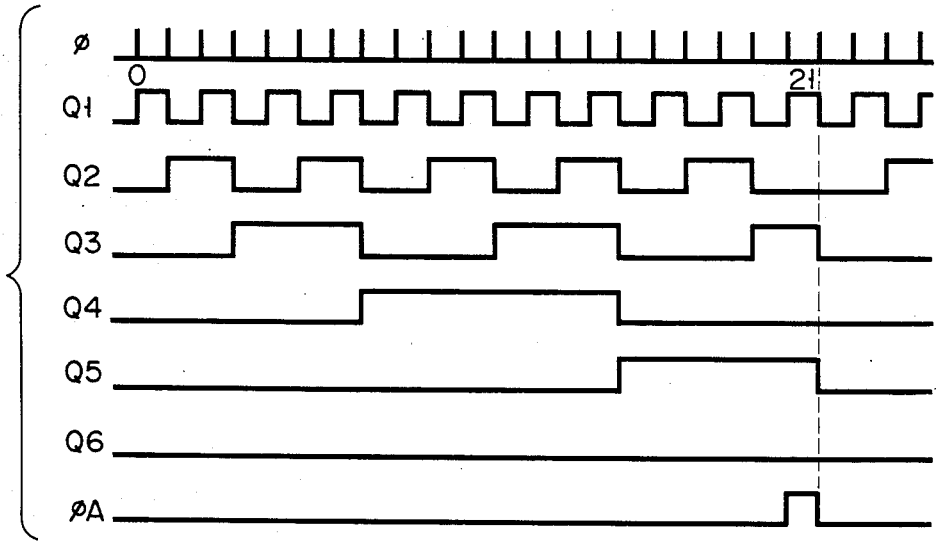
FIG. 8 shows a timing chart for explaining the operation of the generator of FIG. 7.
Figures 9, 10:
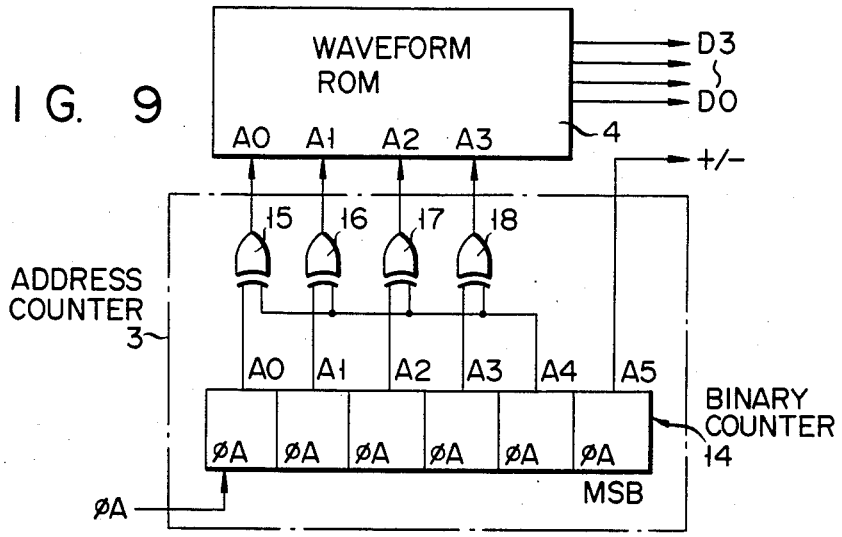
FIG. 9 is a circuit diagram of an address counter and a waveform ROM, which are used in the circuit of FIG. 1.
FIGS. 10 and 11 show a relationship between the address data and the waveform data of the ROM of FIG. 9.

This embodiment will further be described in more detail referring to FIGS. 4, 7 and 9.

FIG. 4 shows a detailed circuit arrangement of the random data generating circuit 1 used in the circuit of FIG. 1. A 4-bit shift register 9 shifts data from the first bit SR1 to the fourth bit SR4 every time a clock signal $\phi_S$ is applied to the register 9. The outputs of the second and the fourth bits SR2 and SR4 of the shift register 9 are applied to an exclusive OR gate 10 an output of which is supplied to the first bit SR1 of the register 9. The output signals of the first and the fourth bits SR1 and SR4 are used as random data N0 and N1, and applied to the step pulse generating circuit 2.

The step pulse generating circuit 2 is arranged as shown in FIG. 7. The random data "N0, N1" are supplied to a decoder D1 directly and through inverters 11 and 12. Circles in the decoder D1 and other decoders D2 and D3 indicate NAND gates. Four lines a to d are commonly arranged in the decoders D1 to D3, each being connected to some of the NAND gates of the decoders D1 to D3 as shown in FIG. 7. One of the lines a to d is selected according to the values of the random data "N1, N0" applied to the decoder D1. The data "00" selects the line a; the data "01" the line b; the data "10" the line c; the data "11" the line d. The decoder D2 is coupled for reception with the outputs Q and $\overline{Q}$ of all of the bits of a binary counter 13. The binary counter 13 of six bits is driven by a clock signal $\phi 1$. The line a is selected for "1010110(42)" of the counted value of the binary counter 13. The line b, for "010101(21)". The line c for "010111(23)". The line d, for "110101(53)". When any one of these lines a to d is selected, a logical "0" signal (low level) is produced through the selected line. Under this condition, the decoder D3 produces a logical "1" signal (high level) in response to "0" signal from the decoder D2, to clear all of the bits of the binary counter 13. The logical "1" signal is also applied, as a step signal $\phi_A$ to the address counter 3.

When the line a is selected by the random data N0, N1", the step pulse generating circuit 2 counts 42 clock pulses $\phi 1$. The circuit 2 produces one step signal $\phi_A$ every time the counted value of the counter 13 reaches "101010(42)". For the selection of the line b, the circuit 2 produces one step signal $\phi_A$ every 21 clock signals $\phi 1$. For the selection of the line c, one step pulse $\phi_A$ is produced every 23 clock signals $\phi 1$. For the selection of the line d, one step pulse $\phi_A$ is produced every 53 clock signals $\phi 1$. In this way, the clock signal $\phi 1$ is frequency divided. In this case, the frequency dividing ratio is changed by the random data "N0, N1". Eventually, the step signal $\phi_A$ with randomly varying period is produced.

The address counter 3 and the waveform ROM 4 are configured as shown in FIG. 9. The step signal $\phi_A$ is applied to a binary counter 14 of 6 bits where it is successively counted. The output signals A0 to A3 of the least significant bit to the fourth bit of the binary counter 14 are input to the first input terminals of exclusive OR gates 15 to 18, respectively. The output signal A4 from the fifth bit is applied to the second input terminals of exclusive OR gates 15 to 18. The output signals A0 to A3 of the exclusive OR gates 15 to 18 are applied as address data for the waveform ROM 4. The waveform data D0 to D3, together with a sign bit +/− at the most significant bit A5 of the binary counter 14, is applied to the multiplier 6 of the tone generating section 5. As described above, the data D0 to D3 are multiplied by the envelope data from the envelope data generating circuit 7, and output in the form of musical tone signals after D/A converted at the D/A converter 8.

Figure 11:
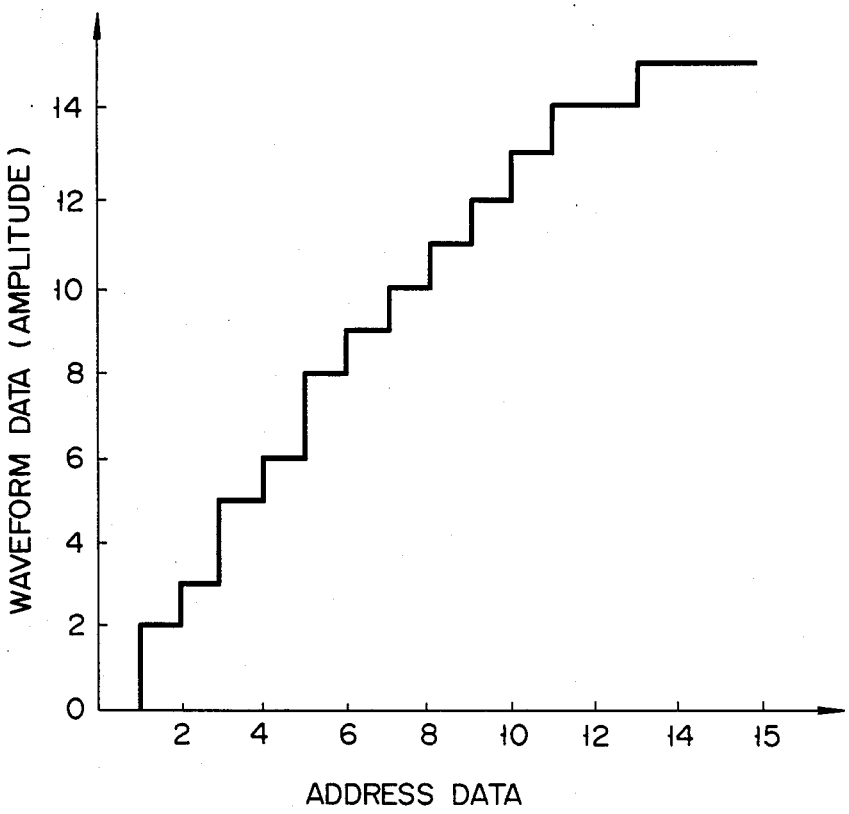

Stored in the waveform ROM 4 are waveform data of the ¼ wave length of a musical tone waveform, as shown in FIGS. 10 and 11. During a period that the contents A5 to A0 of the binary counter 14 changes from "000000(0)" to "001111(15)", the waveform data of the ¼ wave length is read out. During a period that the contents of the counter 14 changes from "010000(16)" to "011111(31)", the output at the fifth bit A4 is "1". Accordingly, the output signals from the first to fifth bits are inverted by the exclusive OR gates 15 to 18, and applied to the waveform ROM 4. The waveform data are read out in the order from the large value to the small value in the opposite direction to that of the previous ¼ waveform data. In this way, the waveform data of the succeeding ¼ wave length is formed. During the next period from "100000(32)" to "111111(63)", the sixth bit output +/− is "1". It is processed as a minus value. In the succeeding ½ wave length, therefore, although the waveform data is read out as in the former half wave length, a latter half waveform is formed.

The operation of this embodiment will be described referring to FIGS. 5, 6, 8 and 12.

Figures 5, 6:
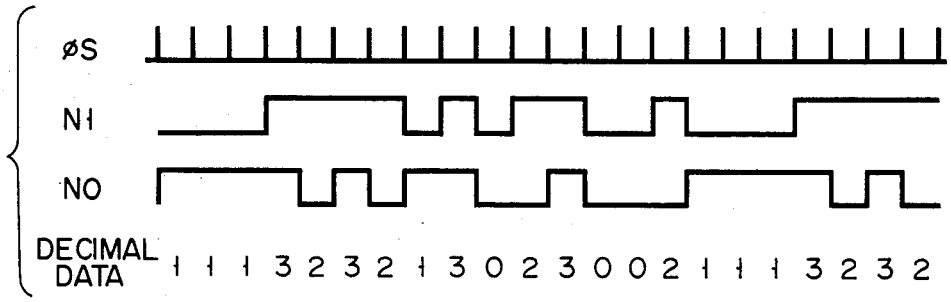
FIG. 5 shows a table showing a relationship among the outputs of an exclusive OR circuit, the contents of a shift register, and random data output from the random data generating circuit of FIG. 4.
FIG. 6 shows a timing chart for explaining the operation of the circuit of FIG. 4.

Assume now that the contents SR4 to SR1 of the shift register 9 in the data generating circuit 1 are "1000". On this assumption, the random data "N1, N0" is "10(2)", and the output signal from the exclusive OR gate 10 is "1". Every time the clock pulse $\phi_S$ is applied to the shift register 9, the data in the register 9 is shifted to the upper stage. The output signal EX from the exclusive OR gate 10 is input to the first bit or stage SR1, so that the random data "N1, N0" change, as shown in FIG. 6.

When the random data "N1, N0" as "10" are applied to the decoder D1 of the step pulse generating circuit 2, the line b is selected. The binary counter 13 starts to count the clock $\phi 1$ from "000000(0)". At the counted value of "010101(21)", the line b is selected also in the decoder D2. Only the data on the line b becomes "0", so that the decoder D3 produces a step signal $\phi_A$, to clear the binary counter 13. Subsequently, a similar process is repeated, and one step signal $\phi_A$ is produced every time 21 clock signals $\phi 1$ are counted.

The step signal $\phi_A$ is applied to the binary counter 14 in the address counter 3. An address to access the waveform ROM 4 is successively stepped from "000000(0)", to read out the waveform data as illustrated in a region I in FIG. 12 and to form a musical tone wave of a first ¼ wave length.

Figure 12:
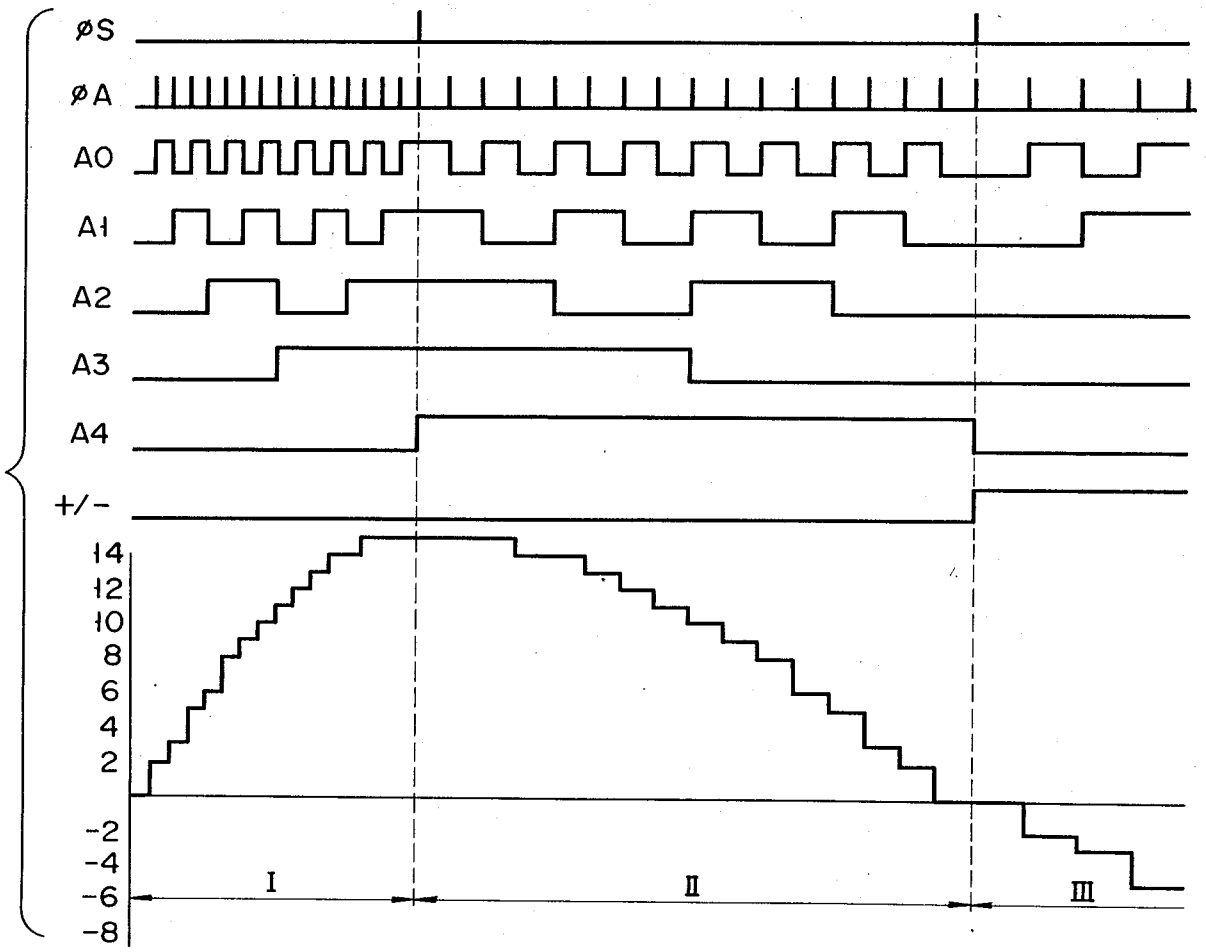
FIG. 12 shows a timing chart for explaining the operation of the circuit of FIG. 9.

When the contents of the binary counter 14 becomes "010000(16)", the lower four bits A0 to A3, "0000", of the counter 14 are inverted into "1111" by the exclusive OR gates 15 to 18. As the lower four bits of the counter 14 are incremented, the address signal from the exclusive OR gates 15 to 18 are decremented. With this process, a tone waveform of a second ¼ wave length is formed as shown in a region II in FIG. 12. At this time, as shown in FIG. 12, the clock signal $\phi_S$ is applied to the shift register 9 in the random data generating circuit 1. When the random data "N1, N0" is "00", the line a in the decoder D1 is selected and the binary counter 13 produces a step signal $\phi_A$ at "101010(42)". Accordingly, one step signal $\phi_A$ is produced for 42 clock signals $\phi 1$ (see the second waveform as counted from the top in FIG. 12). The outputing speed in this case is slower than that in the previous waveform formation in the case of the random data "01".

Accordingly, the period for reading out the waveform of the second ¼ wave length is longer than that of the first ¼ wave length waveform. Thus, the waveform obtained becomes the shown distorted sinusoidal waveform.

In the next ¼ wave length period III, the sixth bit output +/− of the binary counter 14 of the address counter 3 is "1". The waveform data takes a minus sign, to provide a latter half of the musical tone waveform.

In this way, for "00", "01", "10", and "11" of the random data "N1, N0", the period of the step signal $\phi_A$ varies a factor of 42, a factor of 21, a factor of 23, and a factor of 53 of the fixed clock signal $\phi 1$. Accordingly, the read out period of the waveform data varies randomly, thereby to form a distorted waveform of the musical tone signal as shown in FIG. 3.

If the clock signal $\phi_S$ is output at any other appropriate period than the every ¼ wave length, the musical tone waveform varies at the corresponding periods, not for the every ¼ wave length period.

As seen from the foregoing description, the address for reading out the waveform data is stepped according to the step signal changing at random periods. The random change of the period of the step signal depends on the random data. The distorted waveform generator can entirely be realized by a digital circuit. Therefore, the generator can be fabricated into an LSI circuit. The number of necessary parts as well as an area required for fabricating the circuit is reduced. This results in size and cost reduction. Use of the digital circuit makes the generator insensitive to environmental factors such as noise and temperature drift. A high quality of musical tone is secured. Further, merely by changing the output pattern of the random data, a timbre of the generated musical tone can be changed. Various kinds of musical tone can be generated by a single circuit.

What is claimed is:

1. A distorted waveform signal generator, comprising:

random data generating means for successively generating random data containing random values, said random data generating means including:

a shift register containing a plurality of bits which includes at least a least significant bit (LSB) and a most significant bit (MSB); and an exclusive OR gate with input terminals coupled to two of said bits of said shift register, an output of the exclusive OR gate coupled to the LSB of said shift register, and certain bits of said shift register are provided as said random data;

step signal generating means coupled to said shift register for generating a step signal the period of which randomly varies according to said random data;

address counting means coupled to said step signal generating means and arranged to be driven stepwise by said step signal to deliver an output signal;

waveform data memory means arranged to be addressed by the output signal of said address counting means to output sequentially waveform data which determines amplitude of a waveform; and waveform signal generating means coupled to said waveform data memory means for generating a waveform signal the amplitude of which randomly changes according to the waveform data output from said memory means.

2. A distorted waveform signal generator according to claim 1, wherein said shift register contains a first bit as as the least significant bit, a second bit, a third bit, and a fourth bit as the most significant bitr, and the input terminals of said exclusive OR gate are connected to the second bit and the most significant bit.

3. A distorted waveform signal generator according to claim 1, wherein said distorted waveform signal generator includes envelope data generating means for generating envelope data, and multiplying means for obtaining the product of said envelope data and said waveform data, and wherein said waveform signal generating means includes means for forming the waveform signal according to the output signal of said multiplying means.

4. A distorted waveform signal generator, comprising:

random data generating means for successively generating random data containing random values, step signal generating means coupled to said random data generating means for generating a step signal the period of which randomly varies according to said random data, said step signal generating means including:

first decoding means for forming a decode output by said random data;

binary counting means for forming a count output in response to a clock signal of fixed period;

second decoding means for forming a predetermined decode output by the count output of the binary counting means and the output of said first decoding means; and third decoding means for forming the step signal by decoding the output signal of the second decoding means;

address counting means coupled to said step signal generating means and arranged to be driven stepwise by said step signal to deliver an output signal;

waveform data memory means arranged to be addressed by the output signal from said address counting means to output sequentially waveform data which determines amplitude of a waveform; and waveform signal generating means coupled to said waveform data memory means for generating a waveform signal the amplitude of which randomly changes according to the waveform data output from said memory means.

5. A distorted waveform signal generator according to claim 4, wherein said distorted waveform signal generator further includes envelope data generating means for generating envelope data, and multiplying means for obtaining the product of said envelope data and said waveform data, and wherein said waveform signal generating means includes means for forming the waveform signal according to the output signal of said multiplying means.

6. A distorted waveform signal generator, comprising:

random data generating means for successively generating random data containing random values;

step signal generating means coupled to said random data generating means for generating a step signal the period of which randomly varies according to said random data;

address counting means coupled to said step signal generating means and arranged to be driven stepwise by said step signal to deliver address data, said address counting means including:

binary counting means coupled for reception with said step signal;

a plurality of exclusive OR gates, wherein first input terminals of saaid exclusive OR gates are each coupled to different lower order bits of said binary counting means and second input terminals are commonly connected to a bit at a higher order than said lower order bits; and means for supplying output signals of said exclusive OR gates as said address data;

waveform data memory means arranged to be addressed by the address data from said address counting means to output sequentially waveform data which determines amplitude of a waveform; and waveform signal generating means coupled to said waveform data memory means for generating a waveform signal the amplitude of which randomly changes according to the waveform data output from said memory means.

7. A distorted waveform signal generator according to claim 6, including means for attaching to said waveform data the most significant bit (MSB) of said binary counting means as a sign bit.

8. A distorted waveform signal generator according to claim 6, wherein said distorted waveform signal generator further includes envelope data generating means for generating envelope data, and multiplying means for obtaining the product of said envelope data and said waveform data, and wherein said waveform signal generating means includes means for forming the waveform signal according to the output signal of said multiplying means.

* * * * *